United States Patent [19]

Boden et al.

[11] 4,167,671

[45] Sep. 11, 1979

[54] ROTARY ANODE X-RAY TUBE

[75] Inventors: Karl Boden, Julich; Johan K. Fremerey, Bonn; George Comsa, Jülich-Stetternich; Friedrich Gudden, Spardorf; Günther Appelt, Erlangen; Rudolf Friedel, Kleinseebach; Ernst Geldner, Rosstal, all of Fed. Rep. of Germany

[73] Assignees: Kernforschungsanlage Jülich Gesellschaft mit beschränkter Haftung, Jülich; Siemens Aktiengesellschaft, Münich, both of Fed. Rep. of Germany

[21] Appl. No.: 895,769

[22] Filed: Apr. 12, 1978

[30] Foreign Application Priority Data

Apr. 12, 1977 [DE] Fed. Rep. of Germany ..... 2716079

[51] Int. Cl.[2] ..... H05G 1/70

[52] U.S. Cl. ..... 250/406; 313/60

[58] Field of Search ..... 250/402, 406; 313/60

[56] References Cited

U.S. PATENT DOCUMENTS

| | | | |
|---|---|---|---|
| 3,878,395 | 4/1975 | Seifert et al. | 250/402 |
| 4,081,707 | 3/1978 | Hartl et al. | 313/60 |

*Primary Examiner*—Craig E. Church
*Assistant Examiner*—Thomas P. O'Hare
*Attorney, Agent, or Firm*—William R. Woodward

[57] ABSTRACT

Tubular electromagnetic components are mounted on the drive shaft of the rotary anode of an X-ray tube and external magnet windings are provided both for maintaining the drive shaft in an axial position corresponding to a working position of the anode and for shifting the drive shaft to open a slip contact at one end thereof, thus providing a magnetic switch for the anode supply voltage. In addition, windings are provided through which a controlled current flows to provide a radially stabilized position for the shaft and thus constitute magnetic bearings that are free of friction. When one of the contacts of the magnetic switch is spring-mounted, the coil that does the switching can also be used to adjust the axial position of the anode so as to work with a different cathode.

11 Claims, 3 Drawing Figures

ROTARY ANODE X-RAY TUBE

This invention relates to an X-ray tube of the rotary anode type in which the rotary anode is cooled by high temperature radiation cooling and in which the drive shaft of the rotary anode is mounted in contactless magnetic bearings and the anode current is supplied through a separable contact located within the tube envelope.

Rotary anode X-ray tubes in which the rotary anode is not cooled by a cooling medium but dissipates the heat produced, in addition to light energy, during operation of the tube, by giving off heat radiation. Apart from fluoroscope operation, in which the rotary anode tube must be capable of withstanding continuous loads, the application range of these tubes extends to high power densities as a result of the only limited dissipation from time exposures in the range of a few milliseconds. Such short exposures are used in medicinal diagnostic practice, for example X-ray photography of an organ of a living subject, making the use of this type of tube advantageous.

Since the rotary anode in these cases needs to run at full speed—up to 150 revolutions per second in the known tubes—only during the brief exposure flash, it is possible in these cases to switch off the drive of the rotary anode between exposures, in order to hold to a small value the wear of the bearings and of the sliding contact in the anode voltage supply. Such operation, however, is at the price of having to switch on the drive in advance of each exposure and waiting for the necessary speed of the anode to be reached before making the exposure. In order to keep this waiting time as short as possible, rather powerful drive units of a few small kW rating are provided in the known rotary anode X-ray tubes. Even then the waiting time still amounts to about 0.9 seconds and the braking time after the exposure lies in the order of magnitude of 1 second. There is the further disadvantage that in this mode of operation noise cannot be avoided, which is bound to be disturbing particularly in the field of medicine.

German published patent application (OS) No. 2,262,757 shows an X-ray tube in which the rotary anode is kept in rotation during an entire working period in the course of which X-ray exposures are made, a kind of operation in which the X-ray tube anode needs to operate in a magnetic bearing that is as far as possible contactless. In the X-ray tube disclosed in that publication for application in this fashion, however, the contact for transferring the tube current, which is in the form of a point contact, is constituted as a bearing element for the actual bearing support of the anode, so that is is subjected to continuous wear during rotation of the anode. That wear, moreover, since the X-ray tube needs to be switched on only for a short time, is greater than the wear of the anode plate. There is the further disadvantage, moreover, that replacement of the slip contact in such X-ray tubes, which as a rule have a sealed glass envelope, is not possible.

German published patent application (OS) No. 2,422,146 discloses a rotary anode X-ray tube of the same general type in which wear-free magnetic bearings are provided for support of the drive shaft with which trouble-free operation of the drive shaft bearings is intended to make unnecessary the switching off of the drive of the shaft between exposures. The point contact provided as a slip contact for supplying the anode current is continuously in operative position. In this known X-ray tube there is the disadvantage, in case the drive is not switched off and on between exposures, that no safeguards have been provided to prevent premature wearing away of the slip contact. Consequently even in this known X-ray tube switching off the drive between individual exposures cannot be dispensed with.

It is an object of the present invention to provide a rotary anode X-ray tube of the general class above described in which a contactless and therefore wear-free bearing of the drive shaft of the rotary anode is provided and one that can be operated in such a manner that the wear of the slip contact is at a minimum and yet the X-ray tube is ready at any time for operation without requiring a waiting time before making an exposure.

SUMMARY OF THE INVENTION

Briefly, the slip contact through which the anode current is provided to the rotary anode is constituted as a magnetic switch. In this manner it is possible to open and close the slip contact in the anode voltage supply. Since the only still remaining part that is subject to wear in the tube, the slip contact, can be opened and relieved of wear in a simple fashion during rotation of the drive shaft, a highly advantageous mode of operation of the X-ray tube is provided in accordance with the invention, which consists in that the drive shaft is kept in continuous rotation with the slip contact open and the slip contact is closed only for the brief moments of the various exposures. In consequence the X-ray tube according to the invention is in practice ready for operation at any time under conditions of minimum wear, because the switching on of the slip contact does not produce a loss of time. This leads to the further advantage that no disturbing friction noise is produced during the work period in the course of which X-ray exposures are made. A particularly advantageous form of the rotary anode X-ray tube according to this invention results when components of ferromagnetic material are provided on the drive shaft, at least when a stabilization magnet with a substantially constant magnetic field stabilizing the drive shaft axially and having a radially destabilizing effect is provided outside the envelope of the tube and radially stabilizing devices including an electromagnet energized by a control unit and equipped with contactlessly operating displacement-responsive transducers are also provided outside of the envelope to produce an electromagnetic bearing in cooperation with the ferromagnetic material components on the drive shaft. The substantially constant magnetic field stabilizing the drive shaft actually runs substantially axially in the ferromagnetic material components provided on the drive shaft and the radially stabilizing devices serve both to stabilize the drive shaft in radial directions and to compensate the radial destabilizing effect of the axially stabilizing magnet or magnets. The displacement transducers in this embodiment constitute means for indicating radial deviation of the position of the drive shaft from a desired position thereof and to provide signals corresponding to that deviation to the control unit for amplification and shifting in time-phase, for generation therefrom of output signals supplied to the electromagnet for driving back the shaft out of a deviated position into the desired position, the control unit being energized with direct current. At least one direct-current-energized electromagnetic coil is provided that has its winding wound in the circumferential direction with reference to the drive shaft having a magnetic field or fields enveloping the end of at least one of the ferromagnetic components in the drive shaft and thereby exerts an axial force on the drive shaft. Finally, the drive shaft is connected to an electric drive motor of which the rotor is constituted as a metal ring fixed coaxially on the drive shaft while a rotary-field stator winding of the motor is located outside the envelope.

This form of X-ray tube according to the invention is particularly advantageous if galvano-magnetic displacement transducers, as for example field plates, are utilized. Since such transducers are not sensitive to electrostatic disturbances even of high frequencies, a trouble-free operation of the rotary anode is thereby accomplished in accordance with the invention. The additional electromagnet coil provided outside the fixed structure of the X-ray tube in addition to the magnetic bearing components is used to exert axial force on the drive shaft to operate a magnetic switch for the anode voltage. It is constituted in the form of an annular coil and its direction of its magnetic effect is the axial direction of the drive shaft—different from that of the electromagnet coils of the magnetic bearing that serve for radial stabilization. The magnetic field of the switch-controlling coil pulls on the end of the ferromagnetic component of the drive shaft lying within its effective range and produces an axial shift of the drive shaft and thereby an opening and closing of the slip contact.

If the slip contact has at least one member spring mounted, the drive shaft can be shifted axially for a certain path length without opening the slip contact. That provides the possibility of setting different working positions for the rotary anode by supplying direct current to the electromagnet coil that produces axial shift at different levels of strength respectively at times when different positions of the anode are desired. Then, for example, if the cathode is constituted as a double cathode, the operating point of the rotary anode can be adjusted in this manner to the particular cathode ray beam and also to the exit window of the tube and the diaphragm system where the X-rays pass out (i.e. making unnecessary the known procedure of providing a substantial change in focusing by conventional methods for a multi-focus-path rotary anode).

In another form of X-ray tube according to the invention additional displacement transducers are provided for stabilizing the axial position of the drive shaft and are connected to provide signals to the input of a second control unit that provides output signals to coil producing the axial shift for exerting a stabilizing axial force on the drive shaft. This provides for stabilizing axial position of the rotary anode in a prescribed working position even in case the X-ray tube is swung during the Roentgenography exposure.

By the provision of all magnet coils outside the envelope of the tube that is usually made of glass, it is possible to obtain a perfect high vacuum within the tube envelope. In this manner of construction it is also possible to have the envelope or casing of the tube in the neighborhood of the magnetic bearing and of the rotary anode drive to be constituted of a metallic tube.

In still another embodiment the drive shaft is constituted as a hollow shaft closed at one end that surrounds a shaft in fixed position relative to the envelope that is kept at the anode supply voltage. In this case the rotary anode is mounted at the closed end of the hollow drive shaft and the electrical slip contact is provided inside the hollow drive shaft between the drive shaft and the fixed shaft, aligned on their common center line. This form of construction is distinguished by high operating safety, because in the event of a momentarily occuring unbalance of the rotating system or in the event of a sudden failure of the magnetic bearing, the drive shaft will be caught by the fixed axle that it encloses. The additional bearings provided between the fixed and rotating shafts internally of the latter do not contribute, in the case of normal operation of the X-ray tube, to the support of the drive shaft, so that a contactless bearing is produced. They go into action merely in the event of emergencies of the kind already mentioned and also as the drive system and the magnetic bearing are started or switched off. The effectiveness and hence the operating safety of the X-ray tube can be still further increased if the drive shaft and the rotary anode are so designed that the center of gravity of the rotating system is in the region of the enclosed fixed axle.

When there are two axially stabilizing magnets respectively having oppositely oriented magnetic circuits and when at the same time one of the radial stabilization devices is provided for each of the axially stabilizing magnets in such a way that respective ends of the ferromagnetic components are within the range of their respective magnetic fields, a particularly compact form of construction of the bearing is provided for the X-ray tube of the present invention, in which it has been found particularly convenient to provide the electromagnet coil for the axial shift of the drive shaft between the two axial stabilization magnets.

In the use of an X-ray tube it can be necessary, for example in the field of medicine, to swing the X-ray tube instead of the irradiated object. In that case forces are produced perpendicular to the axial direction of the drive shaft that exceed the magnitude of the forces present in the conditions of normal operation. Of course it is basically possible, by corresponding design of the radial stabilization devices to overcome also these forces produced when the X-ray tube is swung or otherwise displaced sideways or vertically. According to the design of the X-ray tube this can lead to substantial loading of the electromagnet coils providing the radial stabilization. This is mitigated or prevented in a form of construction of X-ray tube according to the invention in which an overall low level of power is sufficient to compensate the lateral forces effective at the center of gravity even when the X-ray tube is laterally swung. For this purpose an additional radial stabilization device having an electromagnet activated by a third control unit is provided to produce a magnetic field in the neighborhood of the center of gravity of the anode and its shaft.

The invention is further described by way of illustration with reference to the accompanying drawings in which.

Figure 1:
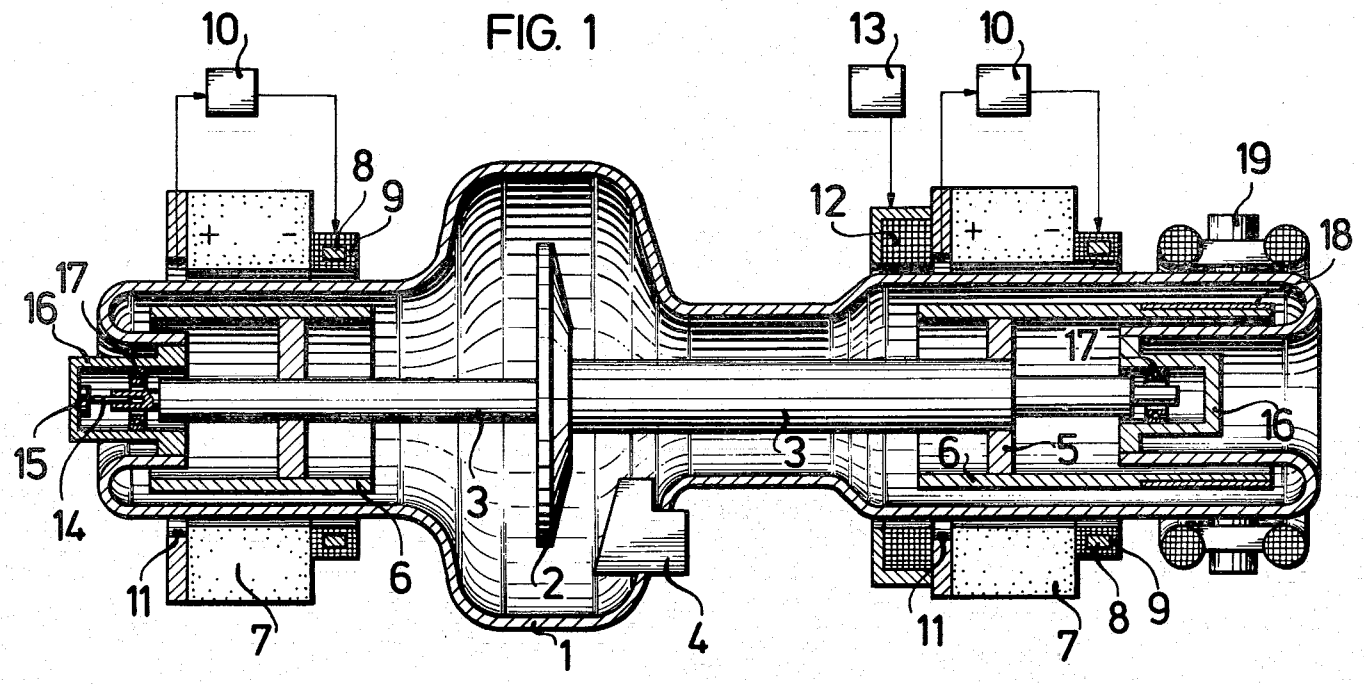
FIG. 1 is a longitudinal section of a rotary anode tube with a drive shaft mounted on bearings respectively at opposite sides of the rotary anode.

As shown in the drawings, the illustrated types of rotary anode X-ray tubes have a disc-shaped rotary anode tube fixed on a drive shaft 3 inside an envelope or casing 1 that maintains the necessary high vacuum. The rotary anode 2 is located opposite a cathode 4. The anode voltage is typically 50 kV with respect to ground and the cathode is 50 kV negative to ground.

In the form of rotary anode tube illustrated in FIG. 1 there are provided at each of the ends of the drive shaft 3 a section of tube 6 consisting of St 35 steel of the American designation AISI C 1008, that is a ferromagnetic material, affixed to the drive shaft in each case by means of a connecting piece 5 of annular shape. Outside of the envelope 1 in the region of these two tube sections 6 are permanent magnet rings 7 for stabilizing the drive shaft in the axial direction. The polarization of the magnet rings 7 is given in FIG. 1. Ring coils are also provided outside the tube for stabilizing the drive shaft in radial directions. These coils have an annular core 8 of ferromagnetic material, in this case steel of the kind used for machine construction, and a helical winding 9. These correspond to the specifications given in German published patent application (OS) No. 2,420,814. The windings 9 are connected electrically with control units 10 and are supplied with direct current by the latter, the level of that current being dependent upon measurement signals that are provided by field responsive plates 11 to the control units 10. These signals are amplified and shifted in phase in the control unit 10 to produce output signals in the form of a controlled direct current supplied to the windings 9.

Another electromagnet coil 12 is provided outside the envelope 1 for setting a drive shaft 3 at a prescribed axial position. The wire of this coil is wound in the circumferential direction of the drive shaft and is supplied with direct current by a command generator 13. The magnetic field of this coil 12 interacts with one end of one of the tube sections 6 consisting of ferromagnetic material. If desired another coil 12 controlled by the same command generator 13 can be provided in a similar position just outside the left end of the other tube section 6 at the left side of FIG. 1.

Since the magnetic field of the coil or coils 12 that can be fed with direct current at one level or another of magnitude by the command generator 13 is a magnetic field operating in an axial direction, it produces an axial shift of the drive shaft 3. In this manner it is possible to open and to close the slip contact constituted by the pin 14 affixed to the end of the drive shaft and the contact plate 15 against which it can be brought to bear, this contact being in the path for supplying the anode current to the rotary anode. The pin 14 consists of tungsten, while the contact plate 15, to which the anode voltage is applied externally, is made of silver. Since the contact plate 15 is spring mounted (by means not shown in FIG. 1) so that the drive shaft can be shifted axially for a certain length without lifting the pin 14 off the contact plate 15 and thereby opening the slip contact, it is furthermore possible, by supplying the ring winding 12 current that one of two different levels of current magnitude, to set the working position of the rotary anode at either of two working positions, and similarly set it at one of more than two positions if desired, it is also possible if desired to adjust the current in order to adjust or calibrate the working position of the rotary anode.

As is furthr indicated in FIG. 1, the ends of the drive shaft 3 are each located within a pot-shaped part 16 made of copper sealed to the envelope 1. Within these parts 16 are lubricant-free ball bearings 17 that are so designed that in normal operation they do not contribute to positioning or holding the drive shaft, but rather serve only as back-up bearings to catch the shaft before it moves far when the stabilizing current of the windings 9 is shut off.

An electric motor with a short circuited rotor and of a few watts' power rating serves to drive the drive shaft 3. The rotor is constituted by a tubular ring 18 of copper affixed and embedded in the tube section 6. The stator 19 of the motor is located outside the envelope 1.

Figure 2:
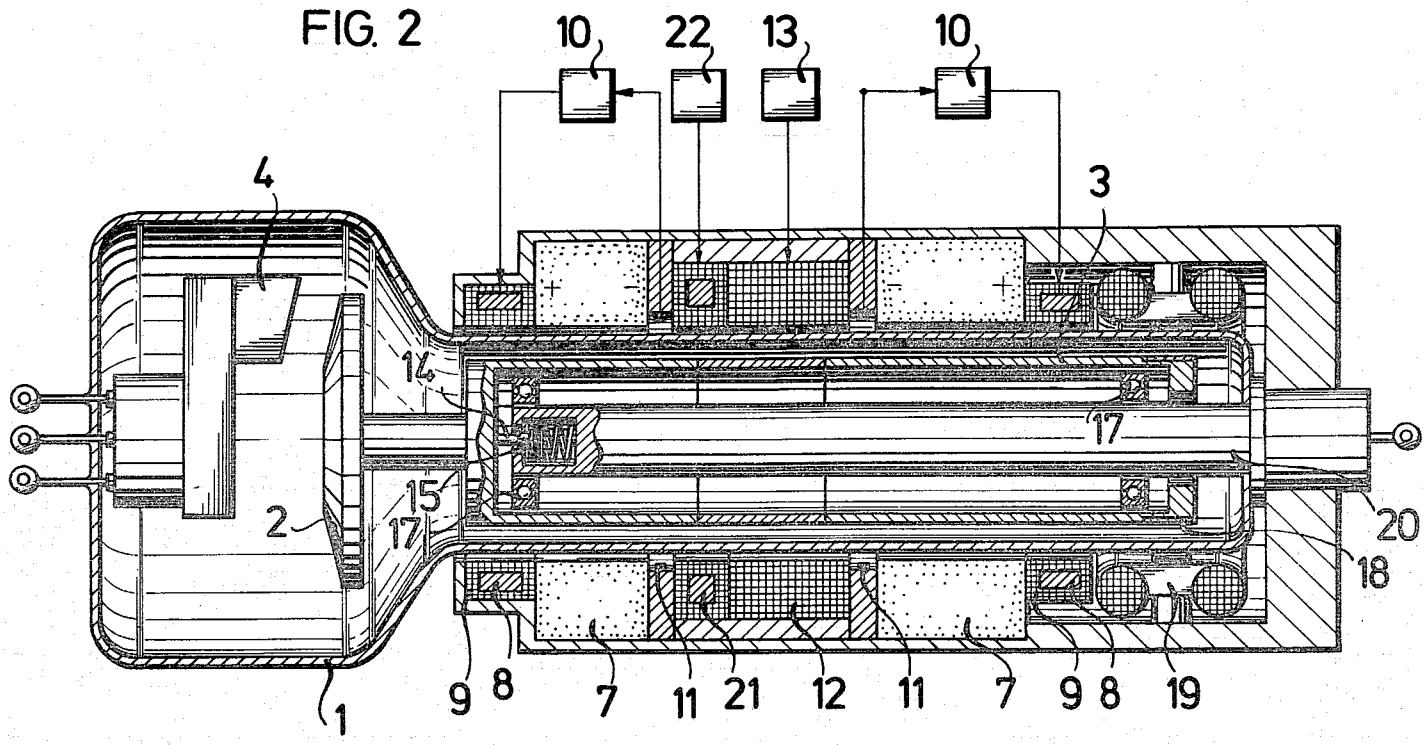
FIG. 2 is a longitudinal section of a rotary anode X-ray tube with a hollow drive shaft having its bearings on one side of the rotary anode.

FIG. 2 shows a form of X-ray tube according to the invention in which the rotary anode is mounted on one end of the drive shaft and the latter has the form of a hollow shaft closed at the anode end. The individual components providing bearings for the drive shaft, control units, etc., as well as the drive motor, largely correspond to the components used for the same purpose in in the X-ray tube of FIG. 1 and to that extent they are therefore designated with the same reference numerals.

In the rotary anode X-ray tube of FIG. 2 the drive shaft portion in the region of the permanent magnets 7 is made of ordinary steel and in the region of the ring coil 12 it is made of non-ferromagnetic steel. Accordingly the magnetic field of the ring winding 12—and likewise the magnetic fields of the permanent magnets—in each case surrounds two end portions of ferromagnetic material pieces.

As can be seen in FIG. 2, the contact plate 15 is mounted on a fixed axle 20 axially spring mounted in the end portion thereof. The axle 20, that is enclosed by the hollow drive shaft 3, is supplied with the anode voltage from the outside. Hence also with this form of rotary anode construction it is possible to set or adjust the rotary anode at different working positions by external control of the axial position of the drive shaft, as well as to open and close the slip contact.

In the X-ray tube illustrated in FIG. 2, there is, provided in addition an electromagnet coil 21 having a magnetic field that lies in the region of the common center of gravity of the rotary anode 2 and its drive shaft 3. This serves to stabilize the radial position of the drive shaft in case the rotary anode is swung, which is to say in which the X-ray tube is swung in position during operation. For this purpose the electromagnet coil 21 is supplied with current by a command generator 22 supplies a direct current of a magnitude that varies in dependence upon the position of the rotary anode and shaft in the space within the electromagnet coil 21.

It has been found in practice that the speed of the rotary anode tube of the present invention can be raised to over 300 revolutions per second, up to the limits imposed by material strength without reducing the useful lifetime of the tube.

Figure 3:
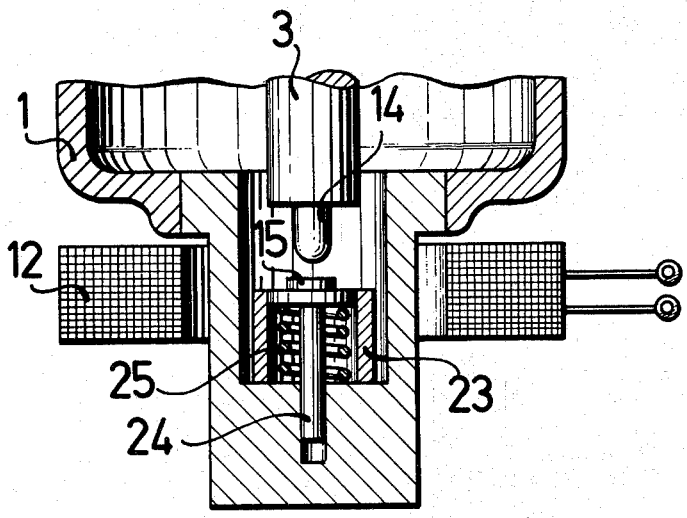
FIG. 3 is a view, also in longitudinal section, of a slip contact constructed in the form of a magnetic switch in a prolongation of the drive shaft.

FIG. 3 shows a modification of the slip contact constituted as a magnetic switch according to the invention, in which, as distinguished from the forms of magnetic switch the illustrative example shown in FIGS. 1 and 2, not the drive shaft 3 and with it the pin 14 but rather the contact plate 15 is moved to open and close the slip contact. For this purpose the contact 15, as is evident in FIG. 3 is mounted on one end of a tube section 23 made of ferromagnetic material that is axially movable towards the drive shaft and has a closed end that confines a spring 25 and holds an inner guiding pin 24.

The spring 25 is mounted as a tension spring that brings the tube section 23 with the contact plate 15 into the rest position illustrated in FIG. 3 and thereby opens the slip contact when the coil 12 is not energized. In this position the tube section 23, as shown in FIG. 3, is only partly in interior region of the coil 12. When the coil 12 is turned on the tube section 23 is therefore pulled towards the drive shaft to close the slip contact by bringing the plate 15 against the pin 14.

We claim:

1. A rotary-anode X-ray tube comprising:

an evacuated envelope;

a rotary anode in said envelope mounted on a drive shaft that is held magnetically in a contactless bearing, said rotary anode being located in said envelope in a manner allowing high temperature radiation cooling thereof;

a cathode in said envelope opposite a portion of said rotary anode;

an electrical slip contact in said envelope for supplying anode voltage for said rotary anode, and electromagnetically operated means for producing relative movement of said contact and of said anode together with its drive shaft for controlling the time at and during which anode voltage is supplied to said rotary anode through said contact.

2. An X-ray tube as defined in claim 1 in which the axis of said drive shaft passes through said electrical contact, and in which said electromagnetically operated means produces axial relative movement of said contact and said drive shaft.

3. An X-ray tube as defined in claim 2 in which:

components of ferromagnetic material are provided on said drive shaft for magnetic bearing support of said drive shaft;

at least one axial stabilization magnet with a substantially constant magnetic field stabilizing said drive shaft axially and having a radially destabilizing effect, and also radially stabilizing devices (8, 9) including an electromagnet (8, 9) energized by a control unit (10) and equipped with contactlessly operating displacement-responsive transducers 11 are provided outside said envelope, said magnetic field stabilizing said drive shaft axially running substantially axially in said ferromagnetic material, said radially stabilizing devices (8, 9) serving to stabilize said drive shaft in radial directions and to compensate the radial effect of said axially stabilizing magnet or magnets (7), said displacement transducers (11) constituting means for indicating radial deviation of the position of said drive shaft from a desired position thereof and to provide signals corresponding to said deviation to said control unit (10) for amplification and shifting in time-phase therein for generation therefrom of output signals supplied to said electromagnet for driving back said shaft out of its deviated position into said desired position, said control unit being energized with direct current;

at least one direct-current-energized electromagnet coil (12) having its winding wound in the circumferential direction, with reference to said drive shaft being provided around said envelope, said electromagnet coil or coils having a magnetic field or fields enveloping the end of at least one of said ferromagnetic components and exert an axial force on said drive shaft, and said drive shaft is connected to an electric motor as a drive therefor in such way that a rotor (18) of said motor is constituted as a metal ring fixed coaxially on said drive shaft, while a rotary-field stator winding of said motor is located outside said envelope.

4. An X-ray tube as defined in claim 3, in which said displacement transducers (11) are galvanomagnetic transducers.

5. An X-ray tube as defined in claim 3, in which at least one member of said electrical contact is spring mounted.

6. An X-ray tube as defined in claim 3, in which a command generator (13) provides output signals of adjustable strength to said coil (12) for adjusting the anode working position.

7. An X-ray tube as defined in claim 3, in which said drive shaft (3) is constituted as a hollow shaft closed at one end that surrounds a fixed shaft (20) kept at the anode supply voltage, said rotary anode is mounted on said drive shaft at said closed end, and said electrical slip contact (14, 15) is provided inside said hollow drive shaft between said drive shaft and the end of said fixed shaft aligned on their common center line.

8. An X-ray tube as defined in claim 7, in which additional lubricant-free bearings (17) are provided inside said hollow drive shaft (3) between said drive shaft and said fixed shaft (20), said bearings being so dimensioned that during effective operation of said magnetically held contactless bearing they do not contribute to the support or bearing of said drive shaft.

9. An X-ray tube as defined in claim 7, in which there are two of said axially stabilizing magnets (7) respectively having oppositely oriented magnetic circuits and in which one of said radial stabilization devices (8, 9) is provided for each of said axially stabilizing magnets (7) so that respective ends of said ferromagnetic components are within the range of their respective magnetic fields.

10. An X-ray tube as defined in claim 9, in which said electromagnet winding (12) with axial direction of effect is located between said two axial-stabilization magnets.

11. An X-ray tube as defined in any of claims 3 to 10 in which an additional radial stabilization device (21) having an electromagnet activated by a second command generator (22) is provided of which the magnetic field lies in the neighborhood of the center of gravity of the anode and its shaft.

* * * * *